US007763349B2

(12) United States Patent
Ochiai et al.

(10) Patent No.: US 7,763,349 B2
(45) Date of Patent: Jul. 27, 2010

(54) PROTECTIVE COATING AND METAL STRUCTURE

(75) Inventors: Hiroyuki Ochiai, Tokyo (JP); Hiroki Yoshizawa, Tokyo (JP); Mitsutoshi Watanabe, Tokyo (JP); Takashi Furukawa, Tokyo (JP); Issei Otera, Tokyo (JP)

(73) Assignee: IHI Corporation, Tokyo (JP)

( * ) Notice: Subject to any disclaimer, the term of this patent is extended or adjusted under 35 U.S.C. 154(b) by 281 days.

(21) Appl. No.: 11/854,827

(22) Filed: Sep. 13, 2007

(65) Prior Publication Data

US 2008/0066646 A1 Mar. 20, 2008

Related U.S. Application Data

(63) Continuation-in-part of application No. PCT/JP2006/304558, filed on Mar. 9, 2006.

(30) Foreign Application Priority Data

Mar. 15, 2005 (JP) ..... 2005-073792

(51) Int. Cl.
*B32B 3/26* (2006.01)

(52) U.S. Cl. ..... 428/317.9; 428/307.3; 428/310.5; 428/318.4; 428/318.6

(58) Field of Classification Search ..... None
See application file for complete search history.

(56) References Cited

U.S. PATENT DOCUMENTS 4,888,114 A * 12/1989 Gaddis et al. ..... 210/500.25
6,235,370 B1 * 5/2001 Merrill et al. ..... 428/116

FOREIGN PATENT DOCUMENTS

| | | | |
|---|---|---|---|
| EP | 1 544 321 | A1 | 6/2005 |
| JP | 2002-106301 | A | 4/2002 |
| JP | 2004-360731 | A | 12/2004 |
| WO | WO 2004/029329 | A1 | 4/2004 |

* cited by examiner

*Primary Examiner*—Ling Xu
(74) *Attorney, Agent, or Firm*—Oblon, Spivak, McClelland, Maier & Neustadt, L.L.P.

(57) ABSTRACT

A protective coating for protecting a component of a gas turbine engine or such from wear is provided with a base coating consisting essentially of metal and including a pore, and a spherical particle filling the pore, at least a surface of which consists essentially of a ceramic.

6 Claims, 5 Drawing Sheets

PROTECTIVE COATING AND METAL STRUCTURE

CROSS-REFERENCE TO RELATED APPLICATIONS

This is a continuation-in-part Application of PCT International Application No. PCT/JP2006/304558 (filed Mar. 9, 2006), which in turn based upon and claims the benefit of priority from Japanese Patent Application No. 2005-073792 (filed Mar. 15, 2005), the entire contents of which are incorporated herein by reference.

BACKGROUND OF THE INVENTION

1. Field of the Invention

The present invention relates to a protective coating for protecting components of a gas turbine engine or such from wear and a metal structure having wear resistance.

2. Description of the Related Art

A gas turbine engine carries out high-speed revolution under high temperatures and its components rub against opposite components. To protect the respective components from wear, protective coatings are in general formed on limited sites which are subject to wear. The protective coating is made of porous metal and fine pores thereof are impregnated with lubrication oil. Japanese Patent Application Laid-open No. 2002-106301 discloses a related art.

The gas turbine engine is used in a very broad temperature range. During a shutdown, it may go down to minus 50 degrees C. In such an environment, the lubrication oil tends to be solidified. On the other hand, during operation, it may reach up to 250 degrees C., at which the lubrication oil could evaporate. Either case would give rise to a problem with lubrication.

SUMMARY OF THE INVENTION

The present invention has been achieved in view of the above problem and has an object for providing a protective coating having a lubrication function and a metal structure having wear resistance, both of which are enabled without any lubrication oil.

According to first aspect of the present invention, a protective coating for protecting a component from wear is provided with a base coating consisting essentially of metal and including a pore, and a spherical particle filling the pore, at least a surface of which consists essentially of a ceramic.

Preferably, the base coating is formed by executing discharge deposition from a working electrode consisting essentially of the metal onto the component with applying the component as a workpiece. More preferably, the protective coating is further provided with a fusion part covering an interface toward the component, the fusion part having a grading composition ratio grading toward the component. Still preferably, the fusion part is 3 μm or more and 20 μm or less in thickness.

According to a second aspect of the present invention, a component applied to a gas turbine engine is provided with a main body having a subject site, a base coating covering the subject site, which consists essentially of a metal and includes a pore, and a spherical particle filling the pore, at least a surface of which consists essentially of a ceramic.

Preferably, the base coating is formed by executing discharge deposition from a working electrode consisting essentially of the metal onto the main body with applying the main body as a workpiece. More preferably, the component is further provided with a fusion part covering an interface toward the main body, which has a grading composition grading toward the main body. Still preferably, the fusion part is 3 μm or more and 20 μm or less in thickness.

According to a third aspect of the present invention, a metal structure applied to a site subject to rubbing is provided with a main body consisting essentially of a metal and including a pore, and a spherical particle filling the pore, at least a surface of which consists essentially of a ceramic.

Preferably, the main body and the particle are formed by sintering a mixed powder of a powder consisting essentially of the metal and a powder consisting essentially of the ceramic.

A protective coating having a lubrication function and a metal structure having wear resistance, both of which are enabled without any lubrication oil, are provided.

DETAILED DESCRIPTION OF THE PREFERRED EMBODIMENT

Throughout the specification and claims, several terms are used in accordance with the following definitions. The term "discharge deposition" is defined and used as use of discharge in an electric spark machine for wearing an electrode instead of machining a workpiece to deposit a material of the electrode or a reaction product between the material of the electrode and a machining liquid or a machining gas on the workpiece. Further, the term "discharge-deposit" is defined and used as a transitive verb of the term "discharge deposition".

In certain embodiments of the present invention, an electric spark machine (most of it will be not shown) is used for executing discharge deposition. In discharge deposition, a subject body is set in an electric spark machine as a workpiece thereof, and made closed to a working electrode in a processing bath. Then, in a case of general spark machining, pulsing current is supplied from an external power source to generate pulsing discharge between the workpiece and the working electrode so as to wear the workpiece, thereby the workpiece is machined into a shape complementary to a tip of the working electrode. In contrast, in the discharge deposition, the working electrode instead of the workpiece is worn and a material of the working electrode, or a reaction product between the material of the electrode and a machining liquid or a machining gas is made deposited on the workpiece. The deposit thereby is not only adhered on the workpiece but also may simultaneously undergo phenomena diffusion, weld and such between the deposit and the workpiece and further among particles in the deposit mutually by using energy of the discharge in part.

A first embodiment of the present invention will be described hereinafter with reference to FIGS. 1 and 2.

Figure 1A:
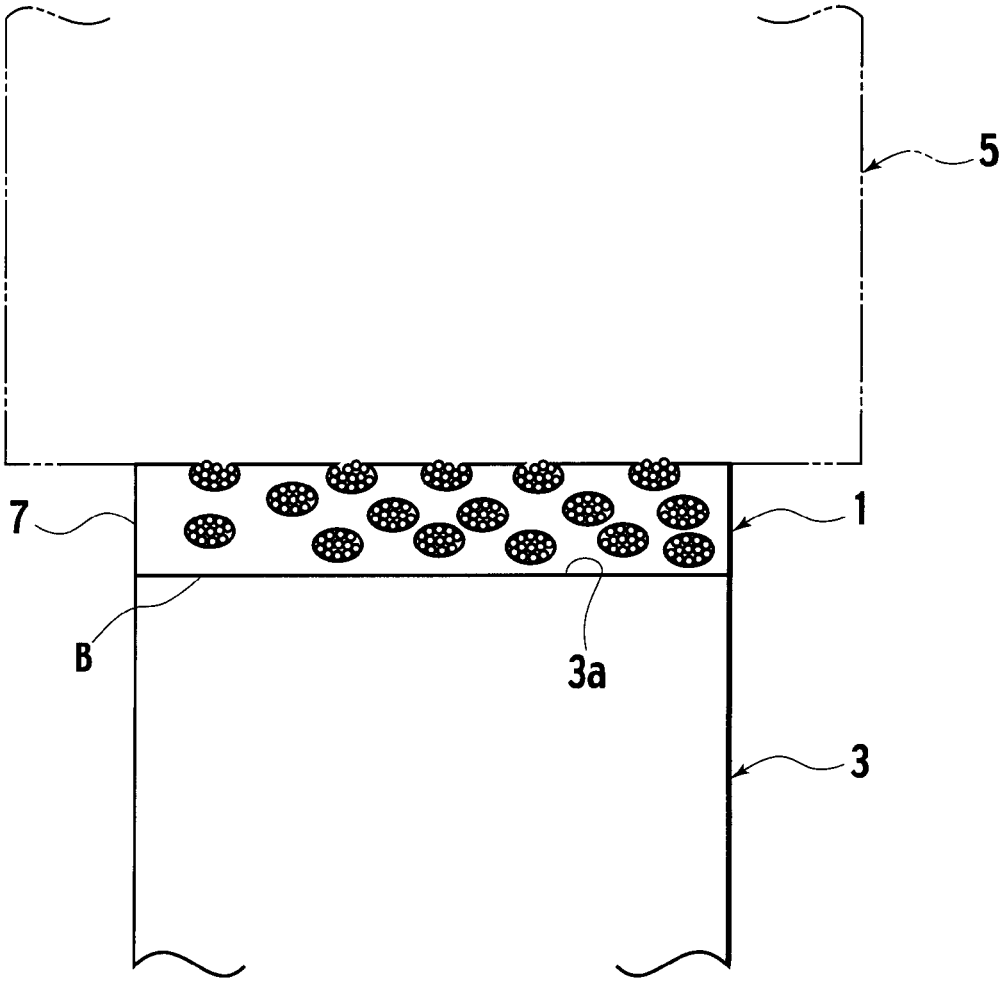
FIG. 1A is a schematic drawing showing a component of an engine having a protective coating in accordance with a first embodiment of the present invention.
Figure 1B:
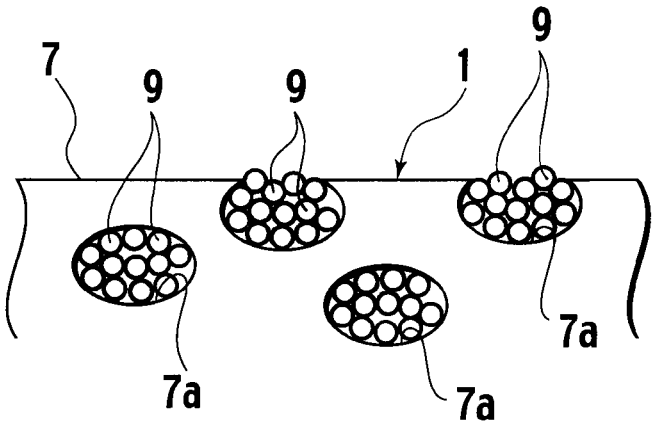
FIG. 1B is a schematic drawing in which the protective coating is magnified.

A protective coating 1 in accordance with a first embodiment of the present invention is applied to an engine component 3 consisting essentially of a metal applied to a gas turbine engine or such. The protective coating 1 is formed on a subject portion 3*a* as a site which rubs against an opposite engine component, as shown in FIGS. 1A and 1B.

The protective coating 1 includes a base coating 7, which consists essentially of a metal and is formed to be porous, and spherical hard particles 9 embedded therein. Here, a preferable example of the metal is an alloy including Co (cobalt), Cr (chromium), and W (tungsten), while any proper metal may be selected and applied thereto.

In fine pores 7*a* of the base coating 7, the spherical hard particles 9 are filled in a rotatable condition. The hard particles 9 consist essentially of $Cr_2O_3$ (chromium oxide) which is one of oxide ceramics. A particle size of the hard particles 9 is preferably 50 μm or less.

It may be modified so that not the whole of but at least surfaces of the hard particles 9 consist essentially of oxide ceramics. Alternatively, carbide ceramics, instead of oxide ceramics, may be applied thereto.

Figure 2:
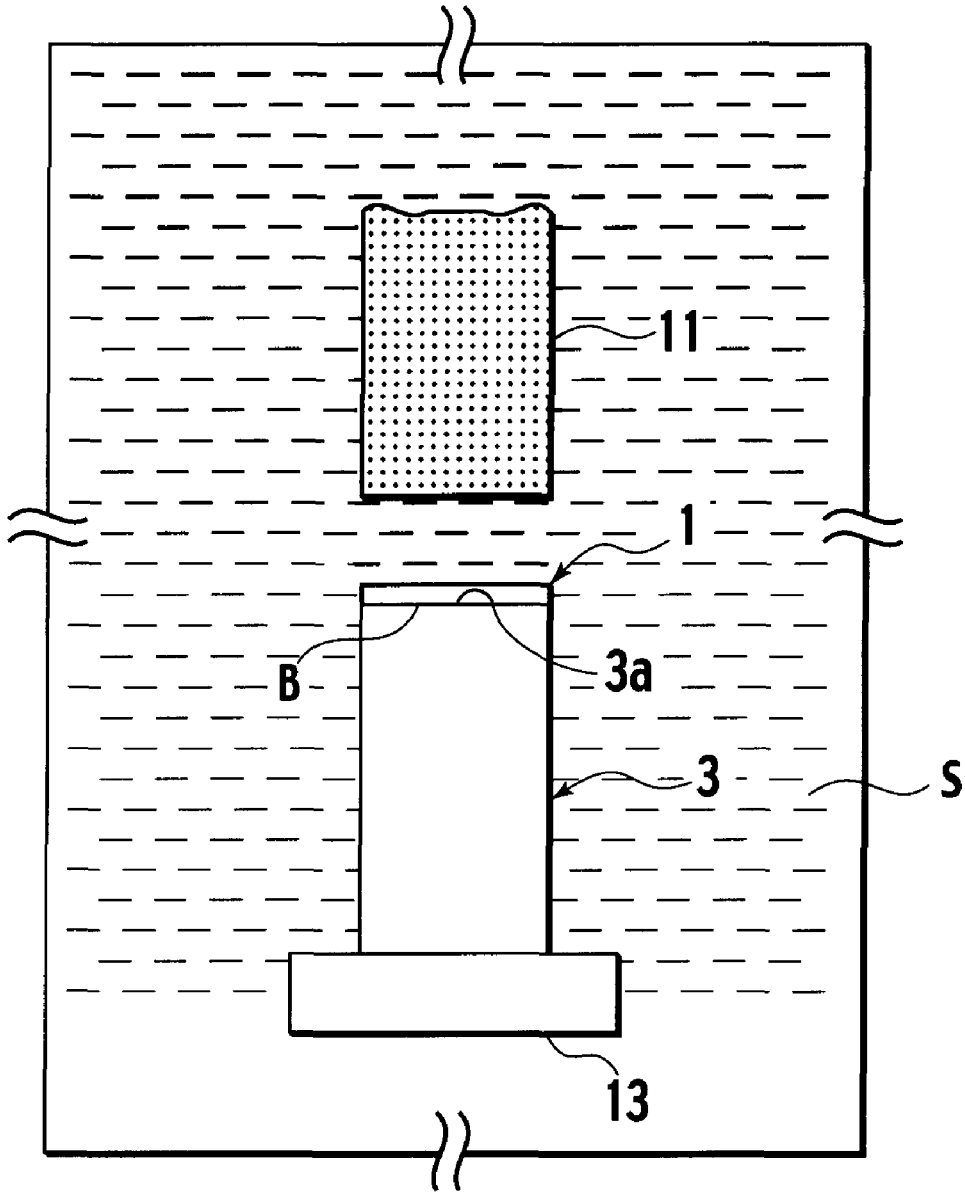
FIG. 2 is a schematic drawing showing a process of forming the protective coating.

As shown in FIG. 2, the protective coating 1 is discharge-deposited by attaching the engine component 3 to a jig 13 as a workpiece of an electric spark machine, having the engine component 3 closed to a working electrode 11 in a processing bath of the electric spark machine, and generating pulsing discharge between a subject portion 3*a* and the working electrode 11 in an electrically insulating fluid S stored in the processing bath.

Here, the working electrode 11 is a molded body made by pressing a mixture of a powder consisting essentially of the metal and the hard particle 9 or the molded body treated with heat treatment so as to be sintered at least in part. Meanwhile, the working electrode 11 may be formed by slurry pouring, MIM (Metal Injection Molding), spray forming and such, instead of pressing. By executing discharge deposition, the metal included in the working electrode 11 is deposited on the workpiece. Further the deposited metal fuses together and/or carries out interdiffusion in itself to form the base coating 7 to leave the fine pores 7*a*. Simultaneously the hard particle 9 included in the working electrode 11 is made filled into the pores 7*a* of the base coating 7. The structure of the base coating 7 formed in such a way inherently allows the spherical hard particles 9 to rotate in the pores 7*a*.

Further, at a boundary between the protective coating 1 and a base of the engine component 3, a fusion part (fusion layer) B in which the composition ratio grades in its thickness direction is formed. The fusion part B is so constituted as to be 3 μm or more and 20 μm or less in thickness by selecting a proper discharge condition at a time of formation of the protective coating 1. Meanwhile, the proper discharge condition may be that a peak current is 30 A or less and a pulse width is 200 μs or less, and more preferably that a peak current is 20 A or less and a pulse width is 20 μs or less.

Figure 3:
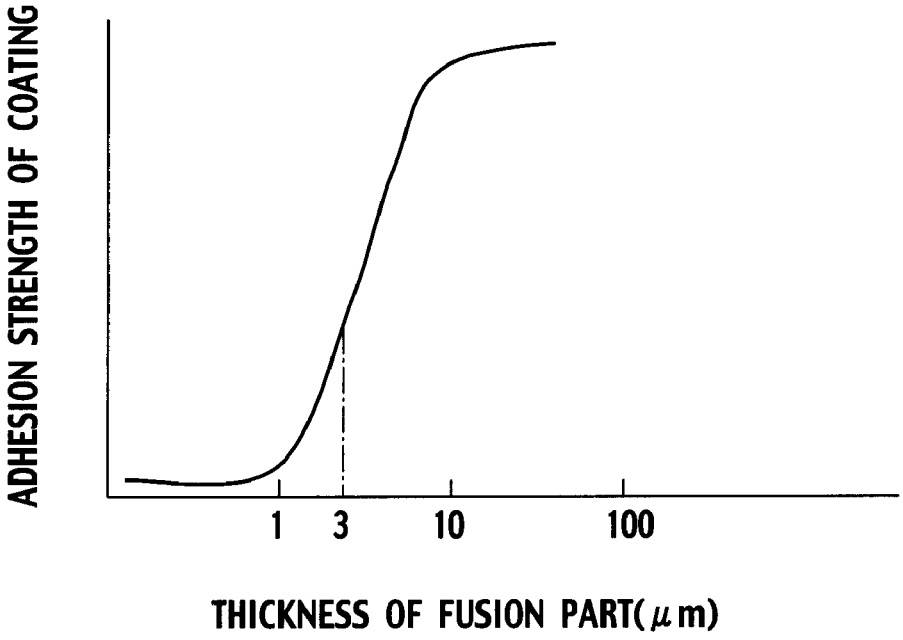
FIG. 3 is a drawing showing a relation between thickness of a fusion part and adhesion strength of a protective coating in a case where the coating is formed by means of the process.
Figure 4:
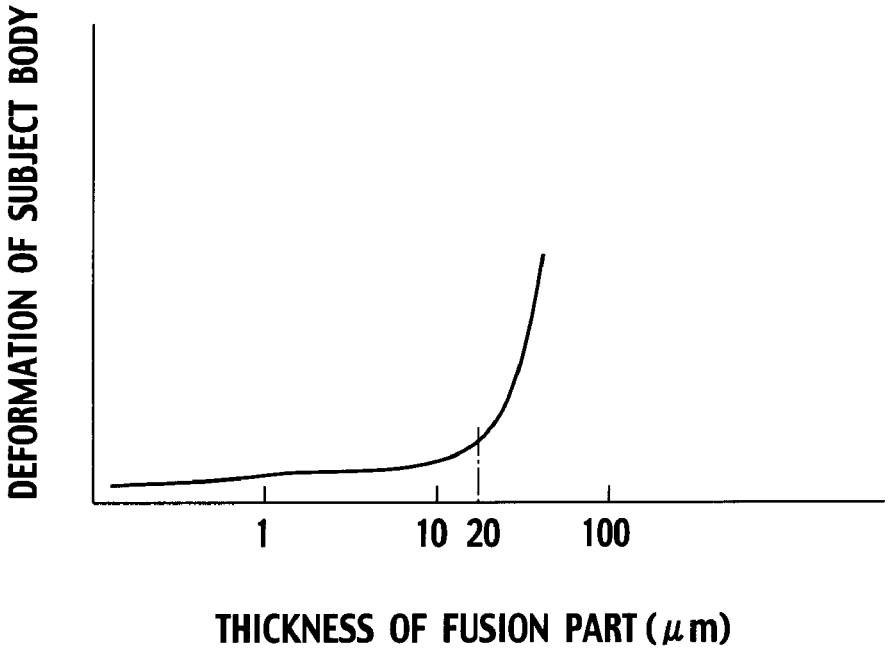
FIG. 4 is a drawing showing a relation between thickness of a fusion part and deformation of the subject body in a case where the coating is formed by means of the process.

Here, a ground on which the thickness of the fusion part B is 3 μm or more and 20 μm or less is based on test results shown in FIG. 3 and FIG. 4.

More specifically, in a case where coatings are formed on metal bases by means of discharge deposition on various discharge conditions, a relation between thickness of the fusion parts and adhesion strength of the coatings is as shown in FIG. 3. A novel first knowledge that the adhesion strength of the fusion part to the coating goes larger when the thickness of the fusion part is 3 μm or more could be obtained. Further, as the relation between the thickness of the fusion part and the deformation of the base is as shown in FIG. 4, a novel second knowledge that deformation of the base can be suppressed when the thickness of the fusion part is 20 μm or less could be obtained. Therefore, the thickness of the fusion part B was set 3 μm or more and 20 μm or less so as to raise the adhesion strength of the protective coating 1 with suppressing the deformation of the base of the engine component 3 from the novel first and second knowledge.

Meanwhile, horizontal axes of FIG. 3 and FIG. 4 indicate logarithms of thicknesses of the fusion parts, a vertical axis of FIG. 3 indicates dimensionless numbers of adhesion strengths of the coatings, and a vertical axis of FIG. 4 indicates dimensionless numbers of deformation of the bases.

Next, actions and effects of the first embodiment will be described hereinafter.

As the fine pores 7*a* of the base coating 7 are filled with the hard particles 9 in a rotatable condition, the hard particles 9 exposed out of the surface of the base coating 7 rotate within the fine pores 7*a* when the engine component 3 rubs against the opposite engine component 5. Thereby the rotating hard particles 9 make the protective coating 1 exhibit a lubrication action without lubrication oil. Therefore, regardless of whether the temperature of the atmosphere in use of the engine component 3 is high or low, adhesive wear of the engine component 3 can be sufficiently suppressed.

Meanwhile, the present invention is not limited to the aforementioned first embodiment and can be enabled on the bases of various embodiments described below.

More specifically, instead of generating pulsing discharge in the electrically insulating fluid S, pulsing discharge may be generated in an electrically insulating gas. Further, instead of forming the protective coating 1 by discharge deposition, the protective coating 1 may be formed by any other proper means.

A second embodiment of the present invention will be described hereinafter with reference to FIG. 5 and FIG. 6.

Figure 5A:
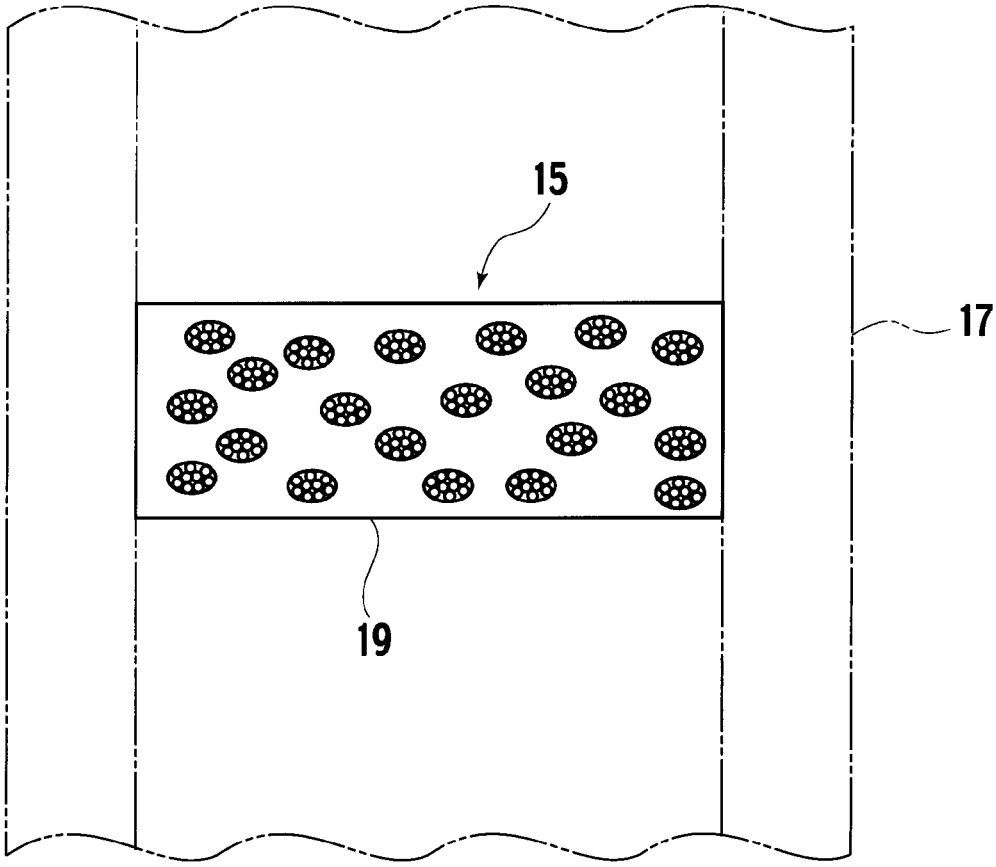
FIG. 5A is a schematic drawing showing a metal structure having a protective coating in accordance with a second embodiment of the present invention.
Figure 5B:
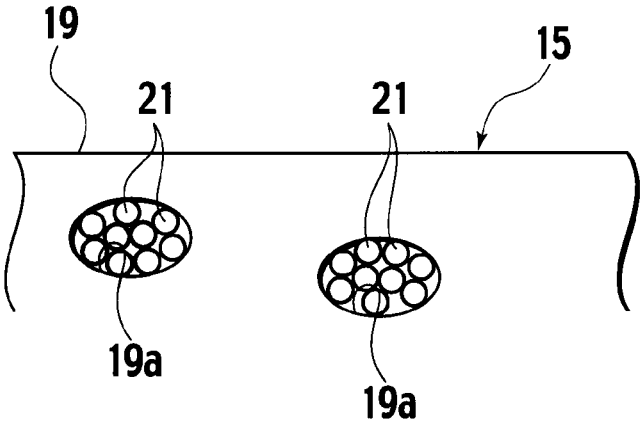
FIG. 5B is a schematic drawing in which the protective coating is magnified.

As shown in FIGS. 5A and 5B, the metal structure 15 in accordance with the second embodiment is a disk-like structure having wear resistance used for an engine or such. A concrete structure of the metal structure 15 is as described later. Meanwhile, an outer peripheral surface of the metal structure 15 is a site which rubs against an inner peripheral surface of an opposite cylindrical engine component (one of opposite metal components) 17.

More specifically, the metal structure 15 is provided with a structure main body 19, which consists essentially of a metal and is formed to be porous. Here, a preferable example of the metal is one of Ni (nickel), Fe (iron) and Cu (copper), or an alloy consists essentially of two or more thereof, while any proper metal may be selected and applied thereto.

In fine pores 19*a* of the structure base body 19, spherical hard particles 21 are filled in a rotatable condition. The hard particles 21 consists essentially of $Cr_2O_3$ (chromium oxide) which is one of oxide ceramics. Alternatively, instead of the oxide ceramics, any carbide ceramic may be applied thereto.

The metal structure 15 is formed by sintering mixed powder 23 of powder of the metal and powder of the oxide (or carbide) ceramic. Each particle of the powder of the ceramic is formed in a spherical shape. The metal structure 15 is formed by three steps including a (i) filling step, a (ii) molding step, and a (iii) heating step.

Figure 6A:
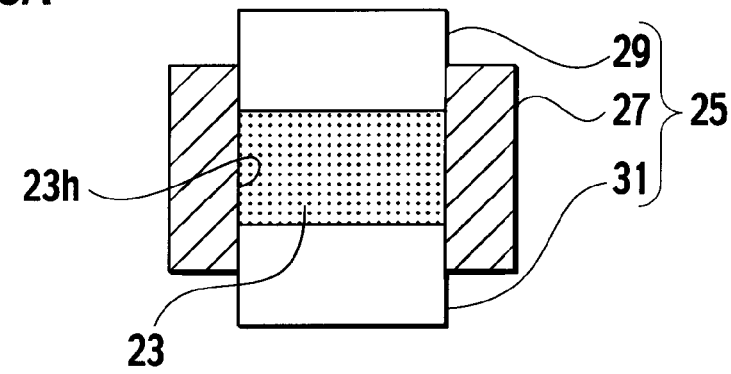
FIGS. 6A-6C are schematic drawings showing a process of forming the protective coating.
Figure 6B:
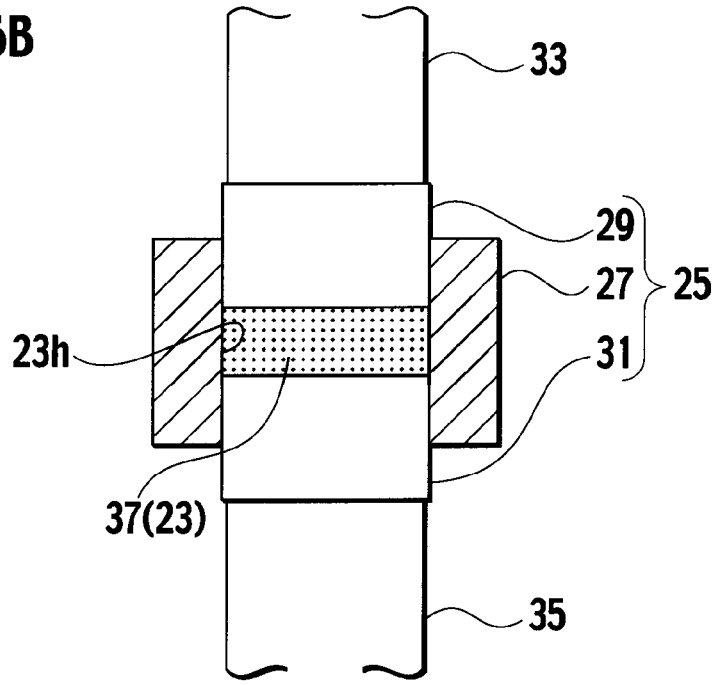
Figure 6C:
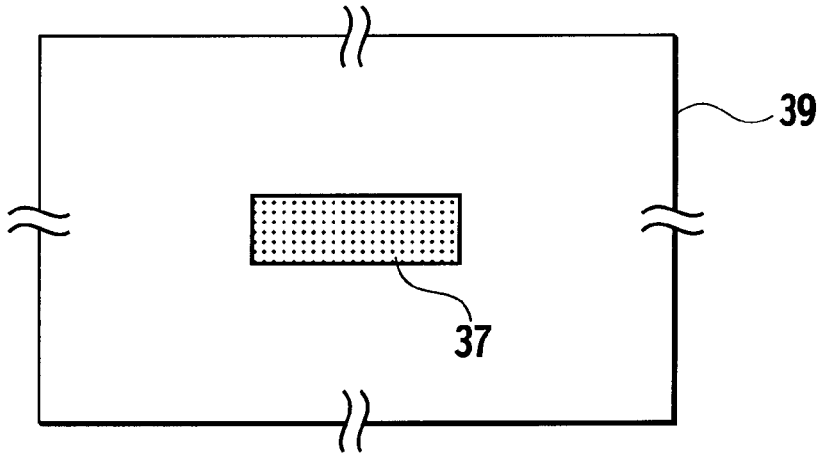

More specifically, as shown in FIGS. 6A-6C, adding wax to the mixed powder 23 and filling the mixed powder 23 in a mold die 25 are carried out ((i) filling step). Here, the mold die 25 is provided with a cylindrical die 27, an upper punch 29 provided above a die hole 27*h* of the die 27 so as to be vertically movable, and a lower punch 31 below the die hole 27*h* of the die 27 so as to be vertically movable. Next, as shown in FIG. 6B, by means of pressurizing force given by an upper ram 33 and a lower ram 35 of a press machine, pressing the mixed powder 23 filled in the mold die 25 to mold the compressed powder body 37 is carried out ((ii) molding step). Subsequently, as shown in FIG. 6C, the compressed powder body 37 is detached from the mold die 25 and heated in a heating furnace 39 such as a vacuum furnace or an atmospheric furnace so as to evaporate and remove the wax and sinter the compressed powder body 37 ((iii) heating step). Thereby, the metal structure 15 made of the sintered compressed powder body 37 is formed.

In the course of the (iii) heating step, the metal included in the compressed powder body 37 fuses together and/or carries out interdiffusion in itself to form the structure main body 19 to leave the fine pores 19*a*. Simultaneously the oxide ceramic or the carbide ceramic included in the compressed powder body 37 is made filled into the pores 19*a* of the structure main body 19 to form the spherical hard particles 21. The structure of the structure main body 19 formed in such a way inherently allows the spherical hard particles 21 to rotate in the pores 19*a*.

Next, actions and effects of the second embodiment will be described hereinafter.

As the fine pores 19*a* of the structure main body 19 are filled with the hard particles 21 in a rotatable condition, the hard particles 21 exposed out of the surface of the structure main body 19 rotate within the fine pores 19*a* when the outer peripheral surface of the metal structure 15 rubs against the inner peripheral surface of the opposite engine component 17. Thereby the rotating hard particles 21 make the metal structure 15 exhibit a lubrication action without lubrication oil. Therefore, regardless of whether the temperature of the atmosphere in use of the metal structure 15 is high or low, adhesive wear of the metal structure 15 can be sufficiently suppressed.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A protective coating for protecting a component from wear, comprising:

a base coating consisting essentially of a metal and including a pore;

a spherical particle filling the pore, at least a surface of the spherical particle consisting essentially of a ceramic; and a fusion part covering an interface toward the component, the fusion part having a grading composition ratio grading toward the component.

2. The protective coating of claim 1, wherein the base coating is formed by executing discharge deposition from a working electrode consisting essentially of the metal onto the component with applying the component as a workpiece.

3. The protective coating of claim 1, wherein the fusion part is 3 μm or more and 20 μm or less in thickness.

4. A component applied to a gas turbine engine, comprising:

a main body having a subject site;

a base coating covering the subject site, the base coating consisting essentially of a metal and including a pore;

a spherical particle filling the pore, at least a surface of the spherical particle consisting essentially of a ceramic; and a fusion part covering an interface toward the main body, the fusion part having a grading composition ratio grading toward the main body.

5. The component of claim 4, wherein the base coating is formed by executing discharge deposition from a working electrode consisting essentially of the metal onto the main body with applying the main body as a workpiece.

6. The component of claim 4, wherein the fusion part is 3 μm or more and 20 μm or less in thickness.

* * * * *